US006896522B2

(12) United States Patent
Harasawa

(10) Patent No.: US 6,896,522 B2
(45) Date of Patent: May 24, 2005

(54) HINGE CONNECTOR, AND CIRCUIT BOARD CONNECTED TO CONNECTOR

(75) Inventor: Masaaki Harasawa, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/485,107

(22) PCT Filed: Aug. 1, 2002

(86) PCT No.: PCT/JP02/07870

§ 371 (c)(1),
(2), (4) Date: Feb. 2, 2004

(87) PCT Pub. No.: WO03/015223

PCT Pub. Date: Feb. 20, 2003

(65) Prior Publication Data

US 2004/0180559 A1 Sep. 16, 2004

(30) Foreign Application Priority Data

Aug. 2, 2001 (JP) ..... 2001-235505

(51) Int. Cl.[7] ..... H01R 39/00
(52) U.S. Cl. ..... 439/17; 439/19; 439/31
(58) Field of Search ..... 439/11–13, 17–28, 439/31

(56) References Cited

U.S. PATENT DOCUMENTS

| | | | | | |
|---|---|---|---|---|---|
| 3,089,113 | A | * | 5/1963 | Mohr | 439/17 |
| 4,475,779 | A | * | 10/1984 | Fohl | 439/21 |
| 4,533,796 | A | * | 8/1985 | Engelmore | 439/24 |
| 4,548,454 | A | * | 10/1985 | Zeller et al. | 439/132 |
| 5,001,659 | A | | 3/1991 | Watabe | |
| 5,429,508 | A | * | 7/1995 | Brevick | 439/15 |
| 5,470,260 | A | * | 11/1995 | Schwan et al. | 439/630 |
| 5,796,047 | A | * | 8/1998 | Sheng-Hsin | 174/135 |
| 5,899,753 | A | * | 5/1999 | Wong et al. | 439/17 |
| 5,923,114 | A | * | 7/1999 | Senni | 310/232 |
| 5,934,911 | A | * | 8/1999 | Stout et al. | 439/21 |
| 6,132,219 | A | * | 10/2000 | Sobhani et al. | 439/17 |
| 6,162,062 | A | * | 12/2000 | Liao | 439/17 |
| 6,196,850 | B1 | * | 3/2001 | Dietz et al. | 439/17 |
| 6,530,784 | B1 | * | 3/2003 | Yim et al. | 439/31 |
| 6,638,074 | B1 | * | 10/2003 | Fisher | 439/22 |
| 6,786,734 | B2 | * | 9/2004 | Yu | 439/11 |

FOREIGN PATENT DOCUMENTS

| | | |
|---|---|---|
| JP | 2-158071 | 6/1990 |
| JP | 5-258823 | 10/1993 |
| JP | 6-7594 | 2/1994 |
| JP | 7-6842 | 1/1995 |
| JP | 2000-268925 | 9/2000 |
| WO | WO 99/44262 A1 | 9/1999 |

* cited by examiner

*Primary Examiner*—Ross Gushi
(74) *Attorney, Agent, or Firm*—Armstrong, Kratz, Quintos, Hanson & Brooks, LLP

(57) ABSTRACT

A hinge connector comprising an insulative connector housing (10) having a predetermined shape, a through hole extending through the connector housing, a receiving chamber defined in the through hole, and an elastic contact member (30) having electric conductivity and a rotatable contact member (50) that are received in the receiving chamber, wherein the elastic contact member (30) is elastically contacted at one end thereof with the rotatable contact member (50), and projects at the other end out of the through hole to form an external contact. This hinge connector is mounted on the main body housing (90) of an electronic device, a circuit board (70) is connected to a cover body, and the contact member (50) is disposed to make rotation contact with the pattern on the circuit board. Such arrangement provides a hinge connector wherein the contact smoothly rotates even if the contact pressure on the circuit board is increased, and good contact can be maintained.

11 Claims, 8 Drawing Sheets

(a)

(b)

HINGE CONNECTOR, AND CIRCUIT BOARD CONNECTED TO CONNECTOR

TECHNICAL FIELD

The present invention relates to a connector, which is used in various kinds of electronic appliances, such as cellular phones, personal computers and the like, and more specifically to a hinge connector, which is suitable for connecting the electric circuit of the main body of the appliance to the electric circuit of a lid member thereof, where the main body and the lid member are joined to each other by a hinge mechanism. The present invention also relates to a circuit board connected to such a connector.

BACKGROUND ART

In compact electronic appliances, cellular phones, personal computers and the like, a hinge mechanism is traditionally used to pivotally couple the main body of an appliance to a lid member, and the electronic circuit of the main body is electrically connected to the electric circuit of the lid member via a flexible ribbon wire inserted into a cylinder element in the hinge mechanism.

However, wiring by means of such a ribbon wire provides no physical support between interconnected members, thereby causing inconvenience to the user. For instance, it is very difficult to insert a ribbon wire into a hole having a very small diameter in a cylindrical element at the time of wiring, and further, the wire is occasionally caught by members other than the cylindrical element, thereby causing in the wiring process. Thus the efficiency of assembling an applicance in an automatic assembly line is greatly reduced.

In view thereof, connectors which do no utilize any ribbon wire have been proposed. For instance, the Examined Japanese Utility Model Registration under Publication No. H06-7594 discloses a hinge connector which comprises a receptacle contact element having a U-shaped receptacle and a tab contact element having a substantially circular tab, which is pivotally engaged with and slides in contact with the inner side of the said receptacle, and the outer peripheral side comes into point-contact with a projected edge of the receptacle in the engaged state.

Moreover, the Unexamined Japanese Patent Application under Publication No. H07-6842 discloses a connector, wherein one end of a first contact element, slides elastically in contact with a ring element mounted onto the main shaft of the hinge mechanism and the other end of which is fixed to a first connection terminal of a first circuit board and wherein one end of a second contact element, slides elastically in contact with the ring element, the other end of which is fixed to a second connection terminal of a second circuit board. Further, in Unexamined Japanese Patent Application under Publication No. H05-258823, an oscillating electrical interconnecting machine is disclosed, in which an electrical contact is formed at the end of a coupling device.

Furthermore, Unexamined Japanese Patent Application under Publication No. 2000-268925 discloses a press-contact connector in which contacts are concentrically arranged on a circuit board to simplify the work of assembly.

However, it has been noted that the above-mentioned connectors have been modified and improved so as to fit the corresponding hinge mechanism in the electronic appliances in which they are employed, and were not used in the buried state of the hinge mechanism itself. Actually, in the hinge connector disclosed in the abovementioned Examined Japanese Utility Model Registration under Publication No. H06-7594, the receptacle contact element and tab contact element are mounted respectively onto corresponding dielectric housings and these housings are coupled with each other via a rotatable concavo-convex structure. As a result, the connector housing cannot be mounted on an element constituting the hinge mechanism, for example, a cylindrical element, making it impossible to miniaturize the connector. Moreover, the connector disclosed in the abovementioned Unexamined Japanese Patent Application under Publication No. H07-6842 has a very complicated structure, which is formed by mounting ring elements in the main shaft to the hinge mechanism, thereby making it impossible to mount the hinge mechanism upon the cylindrical element.

Moreover, the electrical interconnecting machine disclosed in the Unexamined Japanese Patent Application under Publication No. H05-258823 is used on copy machines, and has no similar structure which permits mounting the hinge mechanism upon a cylindrical element. Furthermore, the connector disclosed in the Unexamined Japanese Patent Application under Publication No. 2000-268925 is of the press-contact type, and when such type is used in the above-mentioned hinge mechanism, the repetitive application of the rotary movement causes the reduction of contact reliability and deterioration of the rotary moving property due to the torsion applied to a contact in the rotary movement of the circuit board.

DISCLOSURE OF INVENTION

The present invention aims to solve the abovementioned problems in the prior art, and therefore it is the object of the present invention to provide a hinge connector which is capable of simplifying the assembly work.

The present invention also aims to provide a hinge connector which ensures the smooth rotary movement of the contact portion as well as the maintenance of good contact, even when the contact pressure applied against the circuit board is increased.

In addition, the present invention aims to provide a circuit board, which is adaptable to the above-mentioned hinge connector.

The above objects of the present invention are achieved through the following means:

In one aspect of the present invention, the object is attained by a hinge connector comprising a dielectric connector housing having a predetermined shape, at least one through hole passing through the connector housing, at least one storage space disposed inside the through hole, at least one elastic contact element disposed inside the storage space, and at least one rotatable contact element disposed inside the storage space, wherein the elastic contact element and the rotatable contact element are in contact with each other at one end of the through hole, and at least one external contact portion projecting from a corresponding aperture of the through hole is formed at the other end thereof.

It is preferable that the connector housing has a step or a collar at one end and a profile that would fit the mounting hole of the hinge mechanism in the electronic appliance to be used, and that the connector housing is equipped with a plurality of through holes.

The rotatable contact element can be constituted as a wheel type contact, and shafts are projected substantially from the center of the wheel type contact, wherein end portions of the shafts move while being pivotally supported respectively by substantially U-shaped grooves which are formed on the sidewalls facing each other inside the storage space, and part of the outer periphery of the wheel type contact is projected from the aperture of the through hole.

Alternatively, the rotatable contact element can be constituted as a spherical contact in the form of a ball and rotatably inserted into an aperture leading to the storage space, wherein part of the spherical contact is projected from the aperture of the through hole.

Moreover, the elastic contact element can be constituted as a stripe having a predetermined width, said stripe being bent in a substantially S-shaped form, and the S-shaped stripe has a slit having a predetermined width at the lower end, wherein the wheel type contact is inserted in the slit, and the shafts of the wheel type contact are pressed by small stripes at both sides of the slit.

Alternatively, the elastic contact element can be constituted as a spring member having an arbitrary shape and the spherical contact is pressed by the spring member.

Either press-contact terminals or solder terminals can be formed on the external contact portions of the elastic contact element.

In another aspect of the present invention, the third object is attained by the use of a circuit board, wherein patterns connected to the external contact portions of the rotatable contact element in one of the above-mentioned hinge connectors are concentrically disposed on the circuit board.

In such a circuit board, patterns connected to the external contact portions of the elastic contact element in one of the above-mentioned hinge connectors are disposed on the circuit board.

BEST MODE FOR CARRYING OUT THE INVENTION

The preferred embodiments of the present invention will hereafter be described in relation to the drawings.

Figure 1:
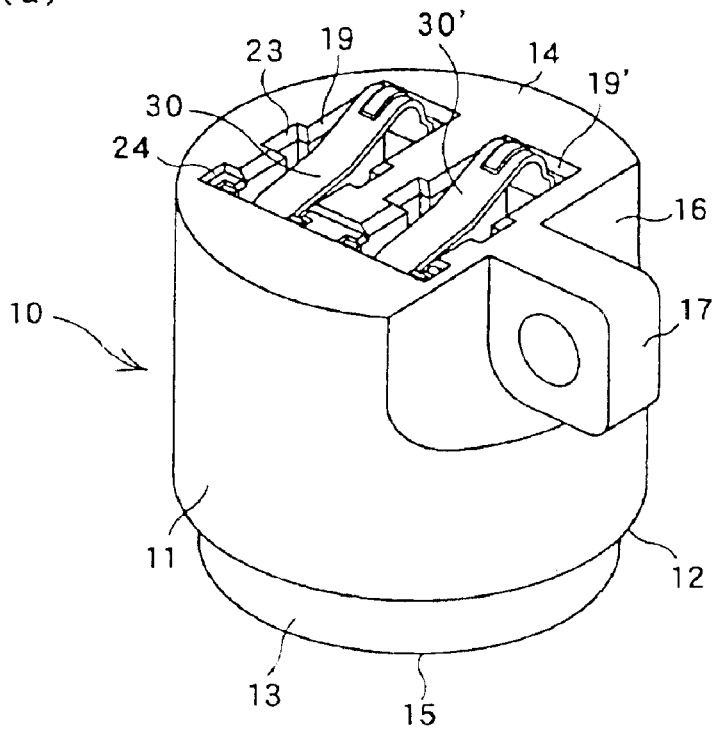
FIG. 1 illustrates perspective views of the hinge connector in the first embodiment, wherein FIG. 1(*a*) is a side view illustrating the contact portions in the upper section and FIG. 1(*b*) is a side view of the contact portions in the bottom section.
Figure 1:
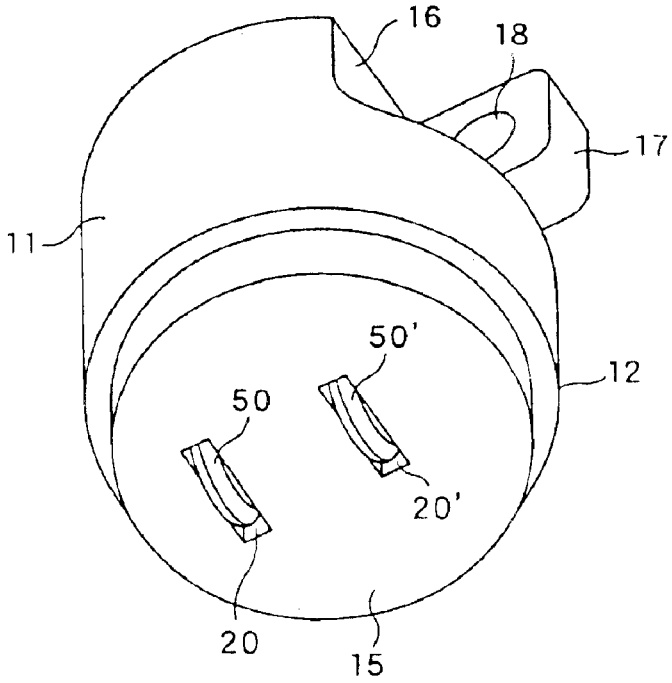
Figure 2:
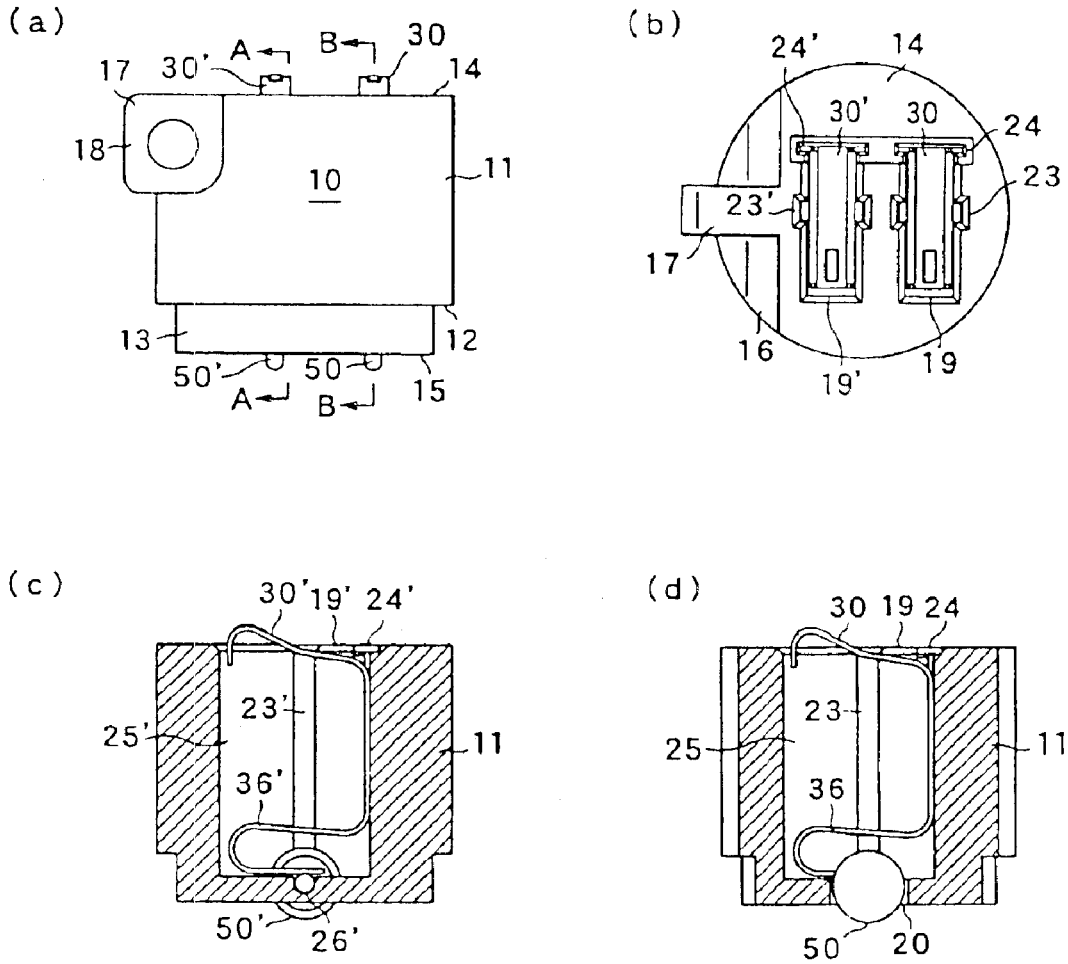
FIG. 2 illustrates the housing main body of the hinge connector drawn in FIG. 1 viewed from different angles, wherein FIG. 2(*a*) is the side view, FIG. 2(*b*) is the plane view, FIG. 2(*c*) is a section viewed from line A—A in FIG. 2(*a*), and FIG. 2(*d*) is a section viewed from line B—B in FIG. 2(*a*).

In FIGS. 1 and 2, the housing main body 11 of a connector 10 is a solid cylinder having a substantially circular section formed from a dielectric material by molding, and it. A flat portion 16 is constituted on the side surface of the solid cylinder, and a mounting projection 17 is provided to protrude from the flat portion 16, along with a possible provision for a mounting hole 18, if required. The mounting hole 18 is used to mount the housing main body 11 onto the housing of an electronic appliance by means of a screw and the like, to prevent the connector 10 from rotating together with the rotating hinge. In this case, the mounting hole is not always a necessary component of the housing main body 11. In the case where the mounting hole is not provided, grooves residing in the corresponding portion of the housing of the electronic appliance provide a function similar to the above due to the outward projection of the mounting projection 17 from the housing main body. Even though the above structural arrangement cannot always be employed in such a mounting and rotation-preventing mechanism, other means can be employed. For instance, convex ribs or concave grooves can also be provided on the outer surface of the housing main body of the connector.

Furthermore, a solid cylinder shaped end portion 13 having a smaller diameter than the housing main body 11 of the connector 10 is formed at the lower end thereof after a step 12. The step 12 serves to determine the position of the housing main body 11, when it is inserted into an aperture (not shown) of the cylinder element forming the hinge mechanism, and also serves as a stopper for preventing the housing main body 11 from dropping out of the aperture. Moreover, the housing main body 11 has a pair of through holes 19 and 19' proceeding from the upper portion 14 of the housing main body of the connector to the bottom portion 15 thereof. The through holes 19 and 19' have the same shape, and the aperture in each such through hole has a substantially rectangular enlarged shape in the upper portion 14, and corresponding apertures 20 and 20' in the bottom portion 15 have a substantially rectangular shape whose size is smaller than the apertures in the upper portion.

In addition, in FIG. 2, storage spaces 25 and 25', each being surrounded by sidewalls, are formed inside the through holes 19 and 19', respectively, and further, U-shaped grooves 23 and 23' extending from the upper portion to the bottom portion are formed at the center of both sidewall surfaces in a longitudinal direction. Moreover, grooves 24 and 24' are formed on the sidewalls having a smaller length in the said through holes (see FIG. 2).

While the profile of the housing main body 11 has been described above as a solid cylinder, the same can take another form, such as those having an elliptic or polyhedral section, provided that they are constituted in such manner as to fit the profile of the connector storage portion of the housing of the hinge mechanism. In such cases, one, or two or more through holes can be used for the housing main body.

Figure 3:
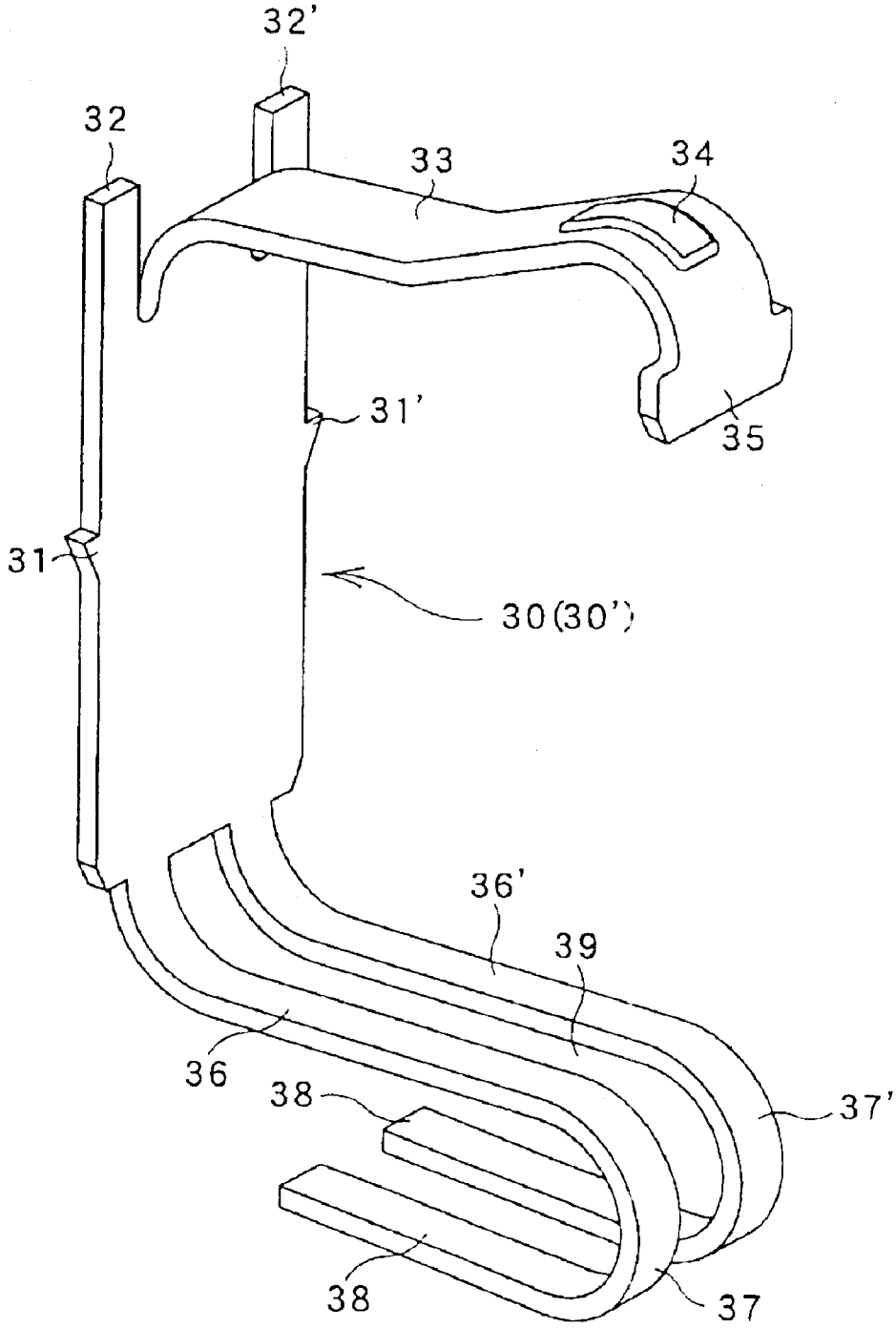
FIG. 3 is an enlarged perspective view of an elastic contact element.

FIG. 3 is an enlarged perspective view of an elastic contact element. Elastic contact elements 30 and 30' have the same shape, so that explanation is given exclusively for a contact element 30.

The elastic contact element 30 comprises an electrical conductive plate-like member in the form of a tape or stripe having a predetermined width. When viewed from the side, the plate-like member appears to have a quasi S-shaped form. The quasi S-shaped member has a flat portion located at the center which is relatively long with a pair of hooks 31 and 31' constituted on either side thereof. The upper portion of the plate-like member has two (2) slits cutting it to form two slightly elongated parts 32 and 32' and a curved plate extending from the flat portion having a width smaller than that of the main part of the plate-like member. The curved plate has a bending portion 33, a contact area 34 and an end portion 35. The contact area 34 serves as a press-contact terminal for the resilient force originating from the bending portion 33. Parts 32 and 32' of the slits as well as the flat portion are engaged with housing grooves, for example, grooves 24, and therefore act as members having a positioning function. Moreover, a slit 39 having a predetermined width cuts the quasi S-shaped member at the bottom in such a way that a pair of fine stripes 36 and 36' is formed where each of the stripes 36 and 36' has an S-shaped bending portion 37 or 37', respectively and a flat portion 38 or 38', respectively. The width of the slit 39 has been determined such that a wheel type contact, described hereafter, can be inserted into the slit.

Figure 4:
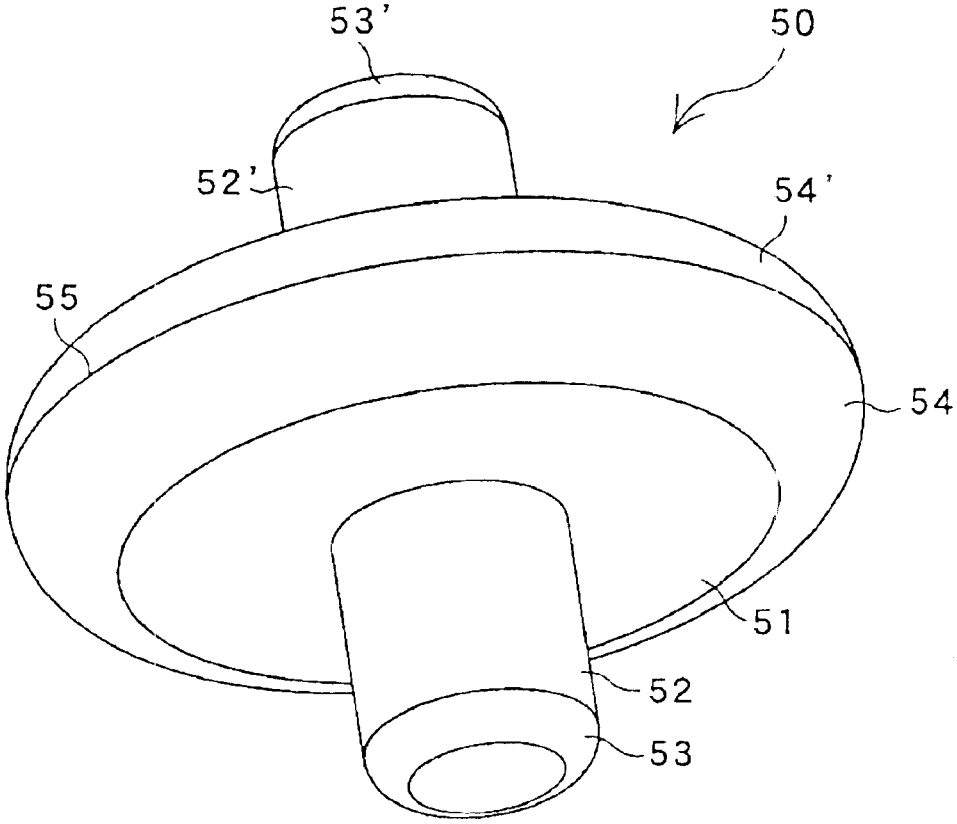
FIG. 4 is an enlarged perspective view of a wheel type contact.

FIG. 4 is an enlarged view of a wheel type contact. The contact has a profile similar to that of a wheel, and therefore called the wheel type contact. In this case, wheel type contacts 50 and 50' have the same shape, so that an explanation is provided exclusively for the wheel type contact 50.

The wheel type contact 50 is made of an electrical conductive material, and comprises a wheel contact 51 having a disk-like shape and shafts 52 and 52' which are projected from the center of the wheel contact 51. The wheel contact 51 has ground peripheral portions 54 and 54', and a contact line 55 is further formed at the outermost part thereof. Moreover, each of the shafts 52, 52' has a chamber 53 or 53' at each end, thereby enabling the shaft to be steadily engaged with the U-shaped groove 23.

In the above description, the wheel type contact is explained so far as a rotatable contact element. However, a spherical contact having a ball shape (not shown) can also be employed instead of such a wheel type contact. In this case, the spherical contact is formed by a ball element having good electrical conductivity and should be designed such that it is rotatable in the corresponding aperture of the housing main body of the connector. In other words, the corresponding aperture at the bottom of the housing main body is shaped in the form of, for example, a cup, and further an aperture is formed at the bottom of the cup, wherein part of the spherical element is designed such that it projects from the aperture, but will not drop out therefrom. Moreover, the elastic contact element may have a shape other than the quasi S-shaped form, for example, an S-shaped elastic element without slits, a spring and the like.

The mounting of the wheel type contacts 50 and 50' and the elastic contact elements 30 and 30' in the housing main body 11 is carried out as follows:

Firstly, the wheel type contacts 50 and 50' are inserted respectively in the corresponding storage space 25 and 25'. In this mounting, the end portions of the shafts 52 and 52' of the wheel type contact are engaged with the U-shaped grooves 23 and 23' in the sidewalls, so that the end portions are positioned at the bottom of the U-shaped grooves in the storage spaces 25 and 25'. Subsequently, the elastic contact elements 30 and 30' are slid into the grooves 24 and 24' of the housing main body from the flat portion at the slit 39, and remain affixed thereto after insertion. In this case, affixing is carried out by pushing the hooks 31 and 31' into the grooves 24 and 24'.

Thereafter, the wheel type contacts 50 and 50' are inserted into the slit 39 and, at the same time, the shafts 52 and 52' of the wheel type contacts 50 and 50' are pressed downward by the pair of flat portions 38 and 38' to produce an electrical connection, thereby causing the contact lines of the wheel type contacts 50 and 50' to be projected from the apertures of the housing. On the other hand, the contact areas 34 and 34' of the elastic contact elements 30 and 30' are projected from the corresponding apertures of the housing main body (see FIG. 3 in conjunction with FIGS. 2(*c*) and 2(*d*)).

In the assembly, the wheel type contacts 50 and 50' are pivotally supported at the bottom of the U-shaped grooves 23 and 23', so that the contacts are rotatable therein. Moreover, the shafts of the wheel type contact are pressed with an elastic force by the flat portions 38 and 38' of the elastic contact elements 30 and 30', and the contact line 55 is pressed from the outside, thereby enabling the shafts to move upward from the bottom of the grooves (see FIGS. 3 and 4).

The structure of the circuit board, to which the contacts are connected, is described hereafter.

Figure 5:
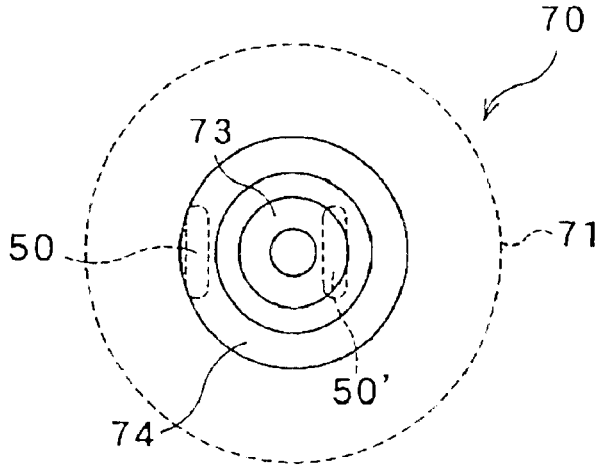
FIG. 5 is the plane view of a circuit board connected to the wheel type contact.
Figure 6:
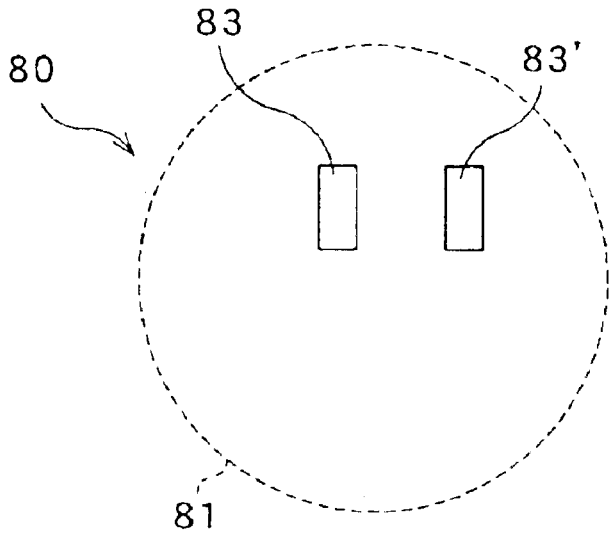
FIG. 6 is the plane view of a circuit board connected to the elastic contact element.

FIG. 5 is the plane view of a circuit board to which wheel type contacts are connected, and FIG. 6 is the plane view of a circuit board to which elastic contact elements are connected.

The circuit board 70 has an arbitrary shape, for instance, in the form of a disk 71 indicated by the broken line. Circuit board patterns 73 and 74, which have a predetermined width and are connected to the wheel type contact are concentrically disposed on the surface of the circuit board. Such a coaxial arrangement of the circuit board patterns 73 and 74 is employed for reasons stated hereafter. When a connector including the wheel type contacts 50 and 50' is installed in the main body of an electronic appliance along with the circuit board 70 affixed to a lid member thereof, and when the rotation of the lid member causes the rotation of the circuit board, the rotation of the circuit board 70 causes the contact line 55 to slide and rotate upon the circuit board patterns 73 and 74, thereby enabling contact to be achieved at any angle of rotation of the lid member.

The spatial relationship between the wheel type contacts 50 and 50' and the circuit board patterns 73 and 74 being in contact therewith are indicated in FIG. 5 by broken lines corresponding to the wheel type contacts 50 and 50'. Furthermore, contact corresponding to the circuit board patterns 73 and 74 on the upper side is formed on the reverse side of the circuit board 70, thereby enabling the said circuit board patterns to be connected to the outside. In this case, one, or two or more patterns can be employed in accordance with the number of the wheel type contacts 50.

Similar to the circuit board 70, the circuit board 80 connected to the elastic contact elements 30 and 30' can take the form of any shape, for instance, a disk 81 as indicated by the broken line in FIG. 6. Circuit board patterns 83 and 83' are disposed on the surface of the circuit board 80 such that they can be connected to the contact areas 34 and 34' in accordance with the position thereof. In this case, one or two or more circuit board patterns can be employed in accordance with the number of the contact areas of the elastic contact elements 30.

Figure 7:
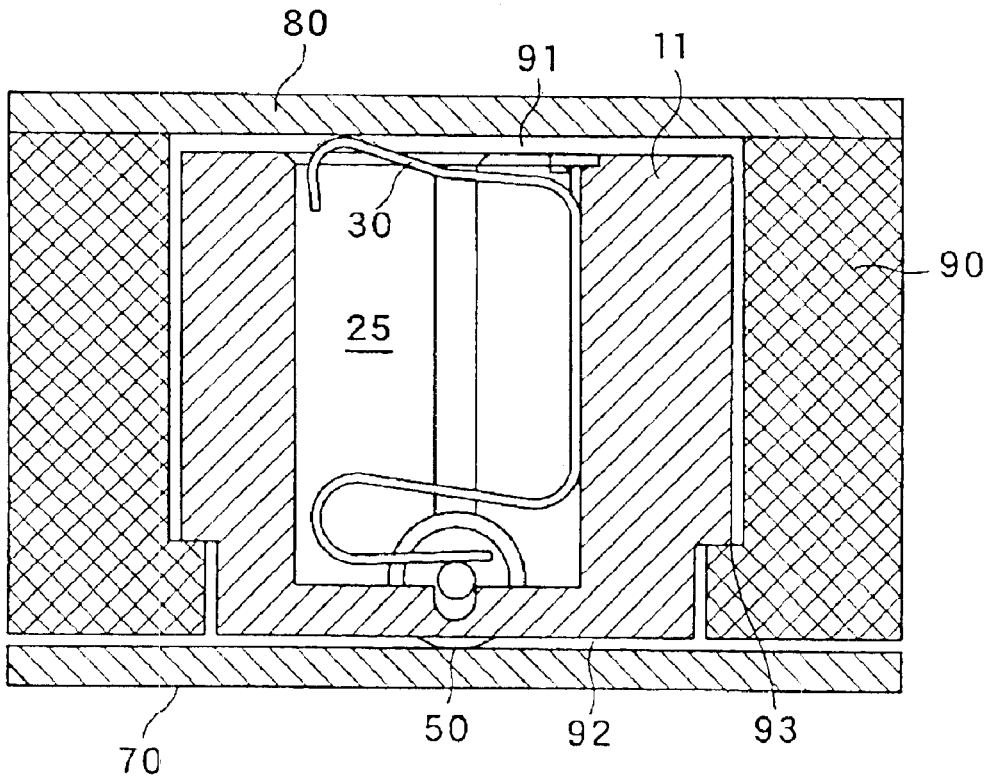
FIG. 7 is the sectional view of the hinge connector mounted on the housing of an electronic appliance in the state of contact with the circuit board.

FIG. 7 is a sectional view of a hinge connector mounted on the housing of an electronic appliance to illustrate the state in which the connector is in contact with the circuit board. The wheel type contact 50 and elastic contact element 30 are inserted beforehand into the storage space 25, and the hinge connector 10 is inserted into the housing 90 of the electronic appliance from the upper aperture thereof, and then step 12 of the hinge connector 10 is provided for as to come into contact with step 93 of the housing 90. In order to maintain such state of contact, the housing 90 is provided with mounting means (not shown) to be used in the same manner as that for the mounting hole 18 of the hinge connector 10, and a connecting element (not shown) is inserted into the mounting hole, thus making it possible to affix the connector to the housing.

Since the flat portions 38 and 38' of the elastic contact element 30 press the shafts 52 and 52' of the wheel type contact 50 respectively in the storage space 25, they are in elastic contact with each other. As a result, the contact line of the wheel type contact 50 in the hinge connector 10 is pushed out of the aperture 20 with a predetermined resilient force, and the contact portion 34 of the elastic contact element 30 is also pushed out of the aperture 19 in a similar manner (see FIGS. 2(*c*) and 2(*d*)).

In such state, the circuit board 80 is first mounted onto the main body of the electronic appliance in such a way that the circuit board patterns 83 and 83' come into press-contact with the contact areas 34 and 34' respectively, thereby ensuring the electrical connection between the circuit board 80 and the hinge connector 10. Subsequently, the circuit board 70 is mounted onto the lid member of the appliance by pressing the contacts 73 and 74 thereof so as to come into press-contact with the contact lines 55 and 55' (the latter 55', not shown) of the hinge connector 10. Accordingly, the rotation of the circuit board 70 disposed in the lid member causes the contact lines 55 and 55' to slide through the contacts 73 and 74 in the state of maintaining a predetermined contact pressure, thereby enabling a good electrical connection to be maintained at any angle, irrespective of the rotation angle of the lid member.

The present invention is not limited to the above-mentioned embodiments, as various modifications are possible. In the hinge connector 10 of the first embodiment, the connection of the connector to the circuit board 80 is established by contact pressure. However, a solder connection or a plug-in connection to a connector of another type can also be employed in accordance with the design concept of the hinge mechanism. These embodiments are described herein below.

Figure 8:
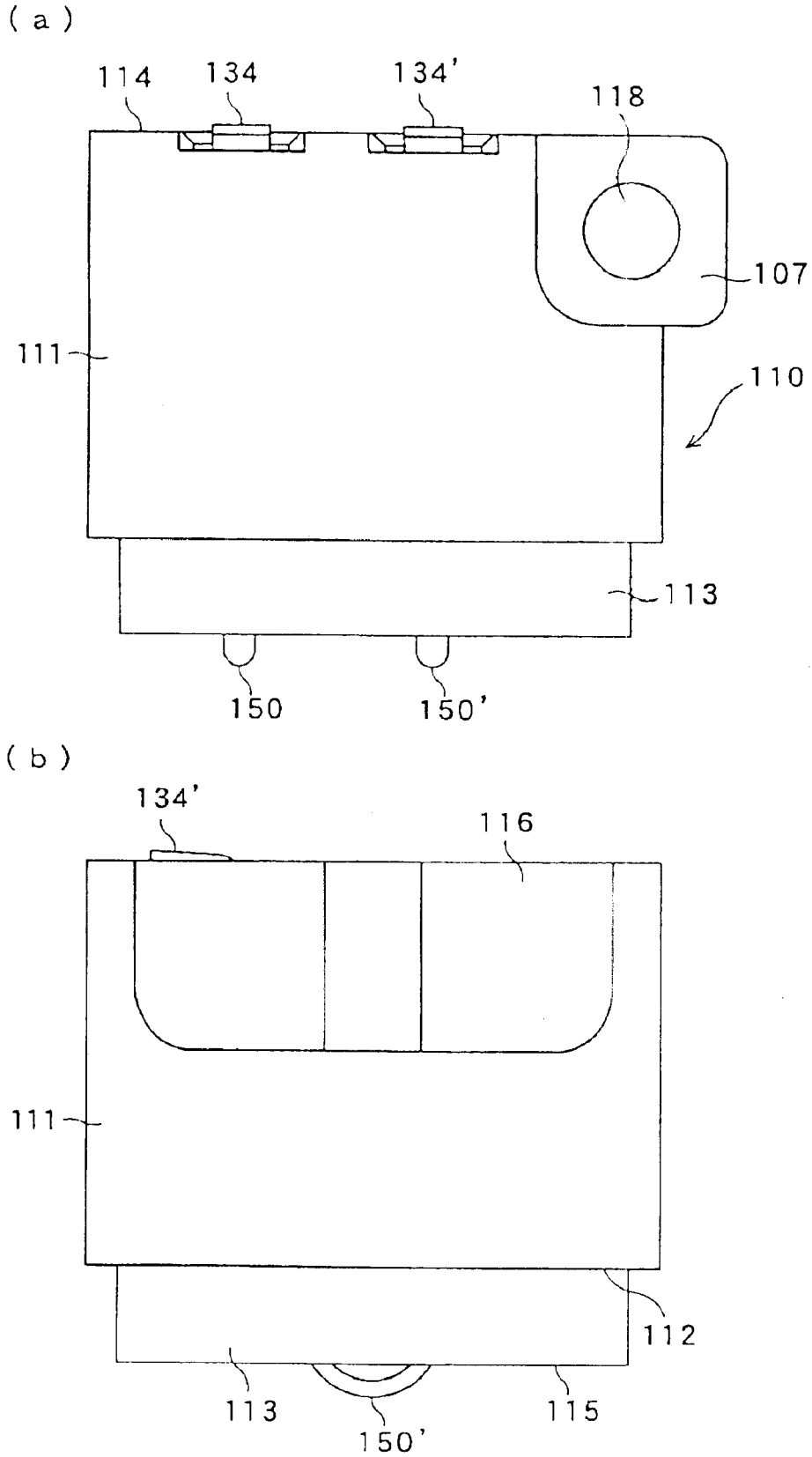
FIG. 8 represents the two (2) side views of the hinge connector in the second embodiment, where FIG. 8(*a*) is one side view and FIG. 8(*b*) is the other side view.

FIG. 8 shows a hinge connector in the second embodiment. FIGS. 8(*a*) and 8(*b*) are side views thereof.

The hinge connector 110 has substantially the same structure as the hinge connector 10 of the first embodiment, except that the external contact areas 34 and 34' of the elastic contact elements 30 and 30' in the hinge connector 10 are replaced with solder terminals.

In other words, the main body 111, step 112, end portion 113, head portion 114, bottom portion 115, flat portion 116, mounting hook 117 and mounting hole 118 of the hinge connector 110 are equivalent to the main body 11, step 12, end portion 13, head portion 14, bottom portion 15, flat portion 16, mounting hook 17 and mounting hole 18 of the hinge connector 10. Moreover, wheel type contacts 150 and 150' correspond to the wheel type contacts 50 and 50' of the hinge connector 10. In this case, the external contact portions of the elastic contact element are constituted in the form of flat terminals 134 and 134' capable of providing a soldering connection.

The formation of contact portions in the elastic contact elements as solder terminals allows the soldering connection to the circuit patterns in the circuit board (not shown). Alternately, lead wires can be connected to the terminals, instead of using a circuit board.

Figure 9:
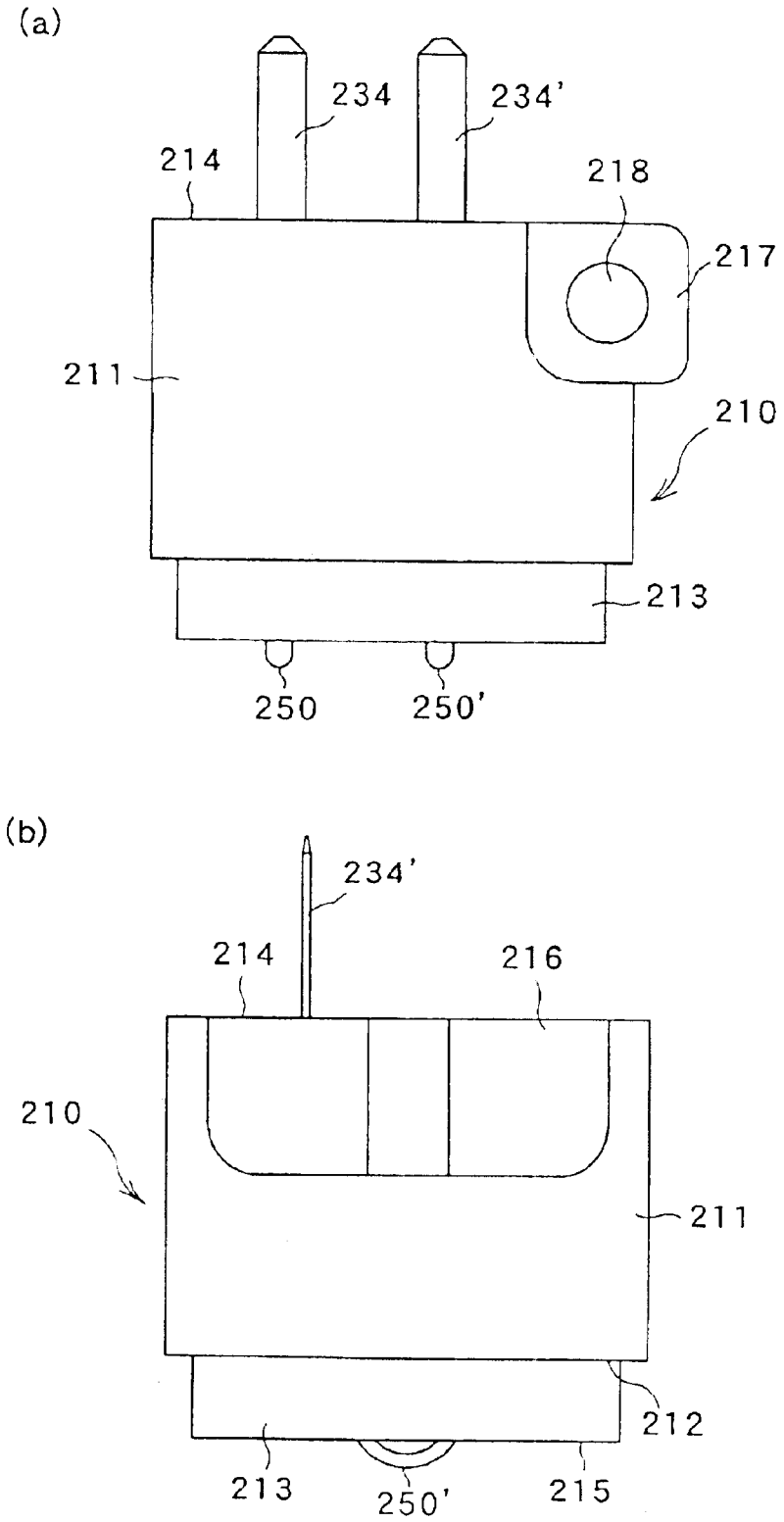
FIG. 9 represents the two (2) side views of the hinge connector in the third embodiment, where FIG. 9(*a*) is one side view and FIG. 9(*b*) is the other side view.

FIG. 9 shows a hinge connector in the third embodiment. FIGS. 9(*a*) and 9(*b*) are side views thereof.

The hinge connector 210 has substantially the same structure as the hinge connector 10 of the first embodiment, except that the external contact areas 34 and 34' of the elastic contact elements 30 and 30' in the hinge connector 10 are replaced with projecting plug-in terminals.

In other words, the main body 211, step 212, end portion 213, head portion 214, bottom portion 215, flat portion 216, mounting hook 217 and mounting hole 218 of the hinge connector 210 are equivalent to the main body 11, step 12, end portion 13, head portion 14, bottom portion 15, flat portion 16, mounting hook 17 and mounting hole 18 of the hinge connector 10. Moreover, the wheel type contacts 250 and 250' correspond to the wheel type contacts 50 and 50' of the hinge connector 10. In this case, the external contact portions of the elastic contact element are constituted in the form of plug-in terminals 234 and 234' capable of providing a plug-in connection to receptacles (not shown). The formation of contact portions in the elastic contact elements as plug-in terminals allows a plug-in connection to the receptacles.

In another embodiment of the hinge connector 210, the projected plug-in terminals are projected from the surface of the circuit board after passing through holes in the circuit board (not shown), and then lead wires and the like can be connected to the tips of the plug-in terminals by soldering. The formation of such plug-in terminals increases the degree of freedom in designing the wiring line arrangement around the hinge mechanism.

Figure 10:
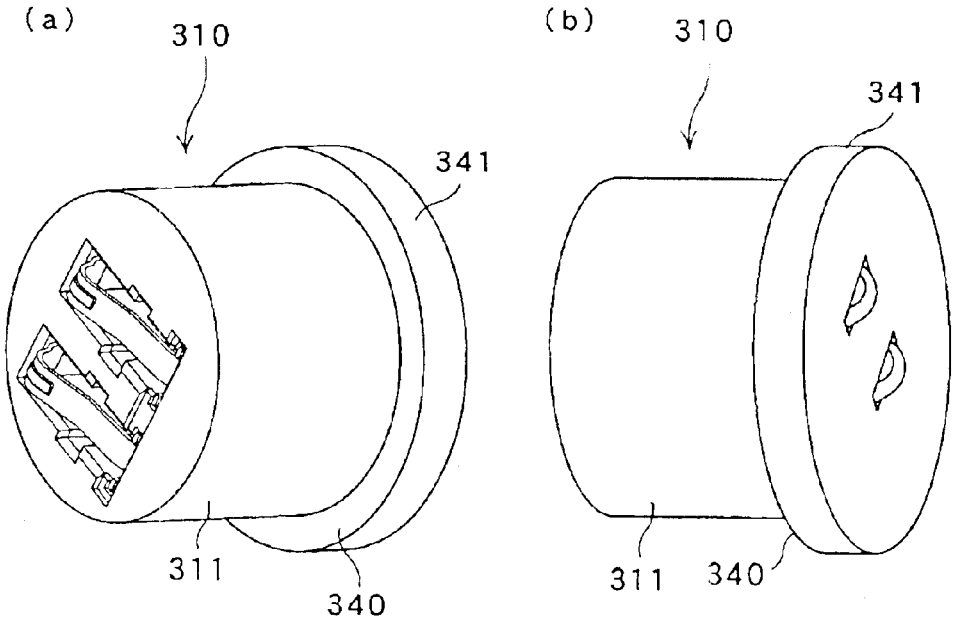
FIG. 10 represents the two (2) side views of the hinge connector in the fourth embodiment, where FIG. 10(*a*) is one side view and FIG. 10(*b*) is the other side view.

FIG. 10 shows a hinge connector in the fourth embodiment. FIGS. 10(*a*) and 10(*b*) are side views thereof. The hinge connector 310 has the same inner structure as that of the hinge connector 10 of the first embodiment, but has a different outer peripheral shape, in that it has a step 340 and a collar 341 at the end of the main body 311. In this case, no rotation-preventing means is provided on the outer peripheral surface of the main body 311. However, it is possible to provide mounting hooks as in the first embodiment, convex ribs or concave grooves in the longitudinal direction, if required.

The main body is inserted into the housing of the electronic appliance through a mounting hole (not shown) on the surface thereof, and then the step of the collar 341 comes in contact with the surface of the housing. In this case, the main body and the housing of the appliance remain affixed to each other by the above-mentioned rotation-preventing mechanism.

INDUSTRIAL APPLICABILITY

As described above, the hinge connector according to the present invention may be mounted upon the hinge mechanism of an electronic appliance so that the working efficiency thereof may be greatly enhanced even without using any wiring ribbon wires and the like. Moreover, the use of rotatable contact elements according to the present invention allows the contact elements to be smoothly rotated and a satisfactory contact to be maintained, even if the contact pressure of the contact elements upon the circuit board is set at a higher level. Further, since the rotatable contact elements rotate smoothly onto the contact elements in the circuit board at any angular position, a good electrical connection may be achieved, along with an increased service life due to the excellent rotation property of the contact elements.

The circuit board according to the present invention is well fitted to such a hinge connector, thereby enabling a good electrical connection to be achieved.

What is claimed is:

1. A hinge connector comprising: a dielectric connector housing having a predetermined shape; at least one through hole passing through the said connector housing; at least one storage space disposed inside the said through hole; at least one elastic contact element disposed inside the said storage space; and at least one rotatable contact element disposed inside the said storage space, wherein the said elastic contact element and the said rotatable contact element are in contact with each other at one end of the said through hole, and at least one external contact portion projected from a corresponding aperture of the said through hole is formed at the other end thereof.

2. A hinge connector according to claim 1, wherein the said connector housing has a step or a collar at one end and a profile fitting to the mounting hole of the hinge mechanism in the electronic appliance to be used.

3. A hinge connector according to claim 1, wherein the said connector housing is equipped with a plurality of through holes.

4. A hinge connector according to claim 1, wherein the said rotatable contact element is a wheel type contact in the form of a wheel, and shafts are projected substantially from the center of the said wheel type contact, and wherein the end portions of the said shafts are movably and pivotally supported respectively in substantially U-shaped grooves which are constituted on the sidewalls facing each other inside the said storage space, and part of the outer periphery of the said wheel type contact is projected from the aperture of the said through hole.

5. A hinge connector according to claim 1, wherein the said elastic contact element is constituted as a stripe having a predetermined width, said stripe being bent in a substantially S-shaped form, and the said S-shaped stripe has a slit having a predetermined width at the lower end, and wherein the said wheel type contact is inserted in the slit, and the shafts of the said wheel type contact are pressed by small stripes at both sides of the said slit.

6. A hinge connector according to claim 1, wherein a press-contact terminal is formed at the external contact portion of the said elastic contact element.

7. A circuit board, wherein patterns, which are connected to the external contact portions of the rotatable contact element in the hinge connector defined in claim 1, are concentrically disposed on the circuit board.

8. A hinge connector according to claim 1, wherein the said rotatable contact element is a spherical contact in the form of a ball, and it is rotatably inserted into an aperture connecting to the said storage space, and wherein part of the said spherical contact is projected from the aperture of the said through hole.

9. A hinge connector according to claim 8, wherein the said elastic contact element is constituted as a spring member having an arbitrary shape and the spherical contact is pressed by the spring member.

10. A hinge connector according to claim 1, wherein a solder terminal is formed at the external contact portion of the said elastic contact element.

11. A circuit board, wherein patterns, which are connected to the external contact portions of the elastic contact element in the hinge connector defined in claim 10, are concentrically disposed on the circuit board.

* * * * *